US009282618B2

(12) United States Patent
Van Beeck

(10) Patent No.: US 9,282,618 B2
(45) Date of Patent: Mar. 8, 2016

(54) METHOD FOR LOCATING LIGHT SOURCES, COMPUTER PROGRAM AND LOCATING UNIT

(75) Inventor: Philipp Van Beeck, Paderborn (DE)

(73) Assignee: Traxon Technologies Europe GmbH, Paderborn (DE)

( * ) Notice: Subject to any disclaimer, the term of this patent is extended or adjusted under 35 U.S.C. 154(b) by 1197 days.

(21) Appl. No.: 13/247,677

(22) Filed: Sep. 28, 2011

(65) Prior Publication Data

US 2012/0105204 A1 May 3, 2012

(30) Foreign Application Priority Data

Sep. 28, 2010 (DE) ..... 10 2010 046 740

(51) Int. Cl.
*G08B 5/22* (2006.01)
*H05B 37/02* (2006.01)

(52) U.S. Cl.
CPC ..... *H05B 37/029* (2013.01); *H05B 37/0227* (2013.01); *H05B 37/0245* (2013.01)

(58) Field of Classification Search
CPC ..... G06F 3/1446; G07C 9/00111
USPC ..... 345/1.1, 594; 315/291; 250/559.36; 358/1.13; 340/815.45
See application file for complete search history.

(56) References Cited

U.S. PATENT DOCUMENTS

| | | | | |
|---|---|---|---|---|
| 5,793,630 | A | 8/1998 | Theimer et al. | |
| 6,865,347 | B2 | 3/2005 | Perkins et al. | |
| 7,495,671 | B2 * | 2/2009 | Chemel et al. | 345/594 |
| 8,902,076 | B2 * | 12/2014 | Pederson | G07C 9/00158 340/815.45 |
| 2002/0122012 | A1 * | 9/2002 | Hofmann et al. | 345/1.1 |
| 2003/0057887 | A1 * | 3/2003 | Dowling et al. | 315/291 |
| 2007/0228307 | A1 * | 10/2007 | Muller | 250/559.36 |
| 2008/0309958 | A1 * | 12/2008 | Nagasaka | 358/1.13 |

FOREIGN PATENT DOCUMENTS

| | | |
|---|---|---|
| DE | 697 30 651 | 2/2005 |
| DE | 10 2009 007 505 | 8/2010 |
| WO | WO2007/099318 | 9/2007 |
| WO | WO 2009/010926 | 1/2009 |
| WO | WO 2010/088887 | 8/2010 |

* cited by examiner

*Primary Examiner* — Benjamin C Lee
*Assistant Examiner* — Israel Daramola
(74) *Attorney, Agent, or Firm* — Cozen O'Connor

(57) ABSTRACT

In at least one embodiment of the method, the latter is set up to locate light sources (1) and has the following steps: a list (L) of light sources (1) in an arrangement (10) is created, each of the light sources (1) having a unique digital identifier (14) with a bit sequence, the light sources (1) are simultaneously driven, with the result that each of the light sources (1) emits a light sequence (11) according to the bit sequence of the identifier (14) associated with the respective light source (1), and an image sequence of the arrangement (10) is recorded using an image recording device (6) during the driving operation, a sequence of images in the image sequence being matched to a sequence of light states (M) in the light sequence (11) in a targeted manner.

15 Claims, 2 Drawing Sheets

METHOD FOR LOCATING LIGHT SOURCES, COMPUTER PROGRAM AND LOCATING UNIT

RELATED APPLICATION

This application claims the priority of German application no. 10 2010 046 740.5 filed Sep. 28, 2010, the entire content of which is hereby incorporated by reference.

FIELD OF THE INVENTION

A method for locating light sources is specified. In addition, a computer program, which is set up to carry out such a method, and a locating unit for such a method are specified.

BACKGROUND OF THE INVENTION

The document U.S. Pat. No. 7,495,671 B2 specifies a lighting organization system.

SUMMARY OF THE INVENTION

An object of the invention is to provide a method which can be used to effect spatial assignment to logical addresses in an automated manner for a plurality of light sources in an arrangement.

According to at least one embodiment of the method, the latter is used to locate light sources in an arrangement, the arrangement comprising a plurality of light sources. The term "locate" means, in particular, that a two-dimensional or three-dimensional image of an arrangement of the light sources is created, the light sources in the arrangement preferably being arranged and/or recorded in the image according to their actual position in space, and the light sources in the image being able to be identified via a unique identifier or address. In other words, the term "locating" may mean that a two-dimensional or three-dimensional model of the actual three-dimensional arrangement of the light sources is created. The model which is, in particular, a computer model can preferably be used to drive the light sources in a targeted manner.

According to at least one embodiment of the method, the light sources to be located are semiconductor light sources such as light-emitting diodes or laser diodes. The light sources may be exclusively semiconductor light sources or else may be a mixture of semiconductor light sources and high-pressure lamps, halogen lamps, incandescent lamps and/or fluorescent lamps. For example, the arrangement or a part of the arrangement, in which the light sources need to be located, has more than ten light sources, preferably more than 100 light sources or more than 500 light sources or more than 1000 light sources. The light sources are preferably connected in such a manner that they can be driven individually and independently of one another. A plurality of light sources may likewise be respectively combined to form a group, individual groups preferably being able to be driven independently of one another.

According to at least one embodiment of the method, the latter comprises the step of creating a list of the light sources in the arrangement or part of the arrangement.

In this case, each of the light sources has a unique digital identifier or address (ID or unique ID for short). The digital identifier comprises a bit sequence. For example, the identifier has at least 16 bits, preferably at least 32 bits or at least 48 bits. All light sources to be located and their identifier are listed in the list.

According to at least one embodiment of the method, the latter comprises the step of simultaneously driving the light sources, with the result that each of the light sources emits a light sequence corresponding to the bit sequence of the identifier associated with the respective light source.

The term "simultaneous" means, in particular, that all light sources are driven within one clock pulse of a clock frequency and can emit a light intensity or light state corresponding to a control signal in the clock pulse. The term "simultaneous" means, for example, within a period of time of one second, preferably within 500 ms or within 250 ms. At least at the end of a clock pulse, all light sources emit a brightness, which is predefined by the control signal for this clock pulse, that is to say the predefined light state corresponding to one bit from the bit sequence. The duration of a clock pulse is, in particular, greater than the period of time needed for all light sources to emit according to the control signal. The light sequences of all light sources preferably run in a parallel and correlated manner, that is to say synchronously, simultaneously and at the same clock rate. All light sources simultaneously emit a brightness, for example corresponding to a tenth bit in the bit sequence.

The fact that each of the light sources to be located emits a light sequence corresponding to the bit sequence of the identifier associated with the light source means that the light states emitted by the individual light sources correspond, over the course of time, to the bit sting of the bit sequence of the respective light source. For example, the respective light source is thus switched on in the event of a 1 in the bit sequence and is switched off in the event of a 0 in the bit sequence. The switching-on operations and the switching-off operations are therefore predefined by the individual successive bits in the bit sequence. If one part of the bit sequence is 1001, for example, the associated light source is switched on in the first clock pulse, is switched off in the second clock pulse, remains switched off in the third clock pulse and is switched on again in the fourth clock pulse.

According to at least one embodiment of the method, the latter comprises the step of recording an image sequence of the arrangement using an image recording device. The image recording device is preferably a digital image recording device such as a digital camera, for example a so-called webcam.

According to at least one embodiment of the method, the image sequence is correlated with the light sequence. The image sequence has, in particular, a sequence of individual images and the sequence of images is matched to the light sequences in a targeted manner. For example, precisely one image is recorded for each clock pulse, in particular toward the end of the clock pulse. Each of the light states of the light sequences running in a parallel manner is preferably recorded by one of the images. In other words, the image sequence represents a recording of the light sequences by the image recording device, in particular at particular times.

In at least one embodiment of the method, the latter is set up to locate light sources and has at least the following steps:

a list of light sources in an arrangement having a plurality of light sources is created, each of the light sources having a unique digital identifier with a bit sequence, the light sources are simultaneously driven, with the result that each of the light sources emits a light sequence corresponding to the bit sequence of the identifier associated with the respective light source, and an image sequence of the arrangement is recorded using an image recording device during the driving operation, a sequence of images in the image sequence being matched to a sequence of light states in the light sequence in a targeted manner.

As a result of the fact that, over the course of time, each of the light sources emits a light sequence having light states corresponding to the bit sequence of the identifier, the light sources in the image sequence can be assigned to an identifier and can be clearly located.

According to at least one embodiment of the method, the latter comprises the step of determining one or more starting points, each starting point being formed by one or more particular light sources. If a two-dimensional model of the arrangement is created, it is possible, if a starting point is present, for the positions of the light sources to be based on this starting point. A spatial position of the starting point in the arrangement is preferably known. It is possible for the light source which represents the starting point to be located first and then for the further light sources to be referenced thereto. The starting point can likewise be determined before driving the light sources with the bit sequence, for example by means of specific illumination, and a center point of the images and/or the image recording device can be oriented thereto, for instance. Furthermore, it is possible to determine at least three starting points whose spatial location relative to one another is known. This makes it possible to determine the distance between the image recording device and the starting points and to state metrics.

According to at least one embodiment of the method, the latter comprises a step in which all of the light sources are switched on together at least once and are switched off together at least once. The light sources are preferably switched on together and switched off again several times in succession. Light source regions can be determined in the images in the image sequence by switching the light sources on and off together. The light source regions are then those regions, preferably restricted to particular pixels in the images, in which a brightness is modulated according to the switching-on and switching-off operations. At least one of the light sources or precisely one of the light sources in the arrangement is preferably respectively imaged in the light source regions. A light sequence of one of the light sources is thus preferably recorded in each of the light source regions over the course of the images in the image sequence.

According to at least one embodiment of the method, a starting image of the arrangement is subtracted from all images in the image sequence. All light sources are preferably switched off in the starting image. Subtracting the starting image from the images in the image sequence makes it possible to reduce or eliminate a background of the arrangement, as a result of which the light source regions can be determined in a more accurate manner. The starting image can also be a plurality of individual images with the light sources switched off, which are averaged, for example in order to efficiently subtract a fluctuating background brightness in the images in the image sequence.

According to at least one embodiment of the method, a profile of a brightness of the light source regions, that is to say one of the light sequences, is compared with the bit sequence of the identifier. If one of the light source regions in successive images in the image sequence first of all appears bright, then dark, dark again and then bright again, for example, a bit sequence of 1001 is assigned to this profile of the brightness. This bit sequence is compared with the bit sequence of the identifier. If the bit sequence corresponds to the bit sequence from the profile of the brightness, the corresponding light source with the associated unique identifier or the unique bit sequence can be uniquely assigned to the corresponding light source region. The bit sequence comprises, in particular, at least 16 bits, preferably at least 32 bits or at least 48 bits.

According to at least one embodiment of the method, at least one of the light source regions comprises a plurality of pixels of the images. One of the pixels is preferably chosen from the plurality of pixels in order to compare the light sequence with the bit sequence. For example, the pixel chosen is the pixel of maximum brightness or a pixel centrally located in the plurality of pixels. Alternatively or additionally, it is possible to average the plurality of pixels of the light source region and to use this averaged value to compare the profile of the brightness with the bit sequence.

According to at least one embodiment of the method, each image in the image sequence is assigned to precisely one light state in the light sequences. A number of images in the image sequence is preferably equal to a number of light states in the light sequences and is equal to a number of bits in the bit sequence. If the bit sequence comprises 32 bits, for example, the image sequence also comprises 32 images and each of the light sequences comprises 32 light states.

According to at least one embodiment of the method, the bit sequence comprises the complete unique identifier. In other words, the bit sequence and the identifier may be identical. Furthermore, it is possible for further bit sequences to precede and/or follow the bit sequence. For example, an initiating sequence precedes the bit sequence and/or a checksum sequence follows the bit sequence.

According to at least one embodiment of the method, at least two image recording devices are used. This makes it possible to record the light sources in three dimensions.

According to at least one embodiment of the method, the arrangement of the light sources is recorded in three dimensions, in which case only a single image recording device which is moved is used and the light sources are then driven again according to the bit sequence. That is to say, the image recording device is first of all moved into a first position and is then moved into a second position, a spatial location of the positions with respect to one another being known. This likewise makes it possible to stereoscopically record the arrangement.

According to at least one embodiment of the method, the light sources are driven several times in succession using the bit sequence and the at least one image recording device respectively records only one part of the arrangement. In other words, an image sequence is respectively focused only on one part of the arrangement. Remaining parts of the arrangement may be recorded by further image sequences. All of the light sources in the arrangement can then be located by a plurality of image recording regions of the individual image sequences being placed next to one another.

According to at least one embodiment of the method, the arrangement of the light sources is intended to illuminate or light part of a building. Alternatively or additionally, the arrangement of the light sources is fitted to part of a building or is set up to be fitted to part of a building. The arrangement can therefore be part of a lighting system for lighting architecture.

A computer program is also specified. The computer program has a program code and is used to carry out a method according to at least one of the preceding embodiments if the computer program is executed in a computer. Features of the method are therefore also disclosed for the computer program and vice versa.

Finally, a locating unit for locating light sources of a lighting system is specified. The locating system comprises at least one computer and a data link which is set up to be connected to the arrangement of the plurality of light sources of the lighting system. In this case, the light sources or groups of light sources can be individually driven. The locating unit also comprises at least one digital image recording device. The locating unit is also set up to carry out a method according to one of the preceding embodiments and/or to execute a corresponding computer program.

Features of the method and of the computer program are therefore also disclosed for the locating unit and vice versa.

BRIEF DESCRIPTION OF THE DRAWING

A method described here and a locating unit described here are explained in more detail below with reference to the drawing and using exemplary embodiments. In this case, the same reference symbols indicate the same elements in the individual figures. However, no references which are true to scale are illustrated in this case; rather, individual elements may be illustrated on an excessively large scale for better understanding.

DETAILED DESCRIPTION OF THE DRAWING

Figure 1:
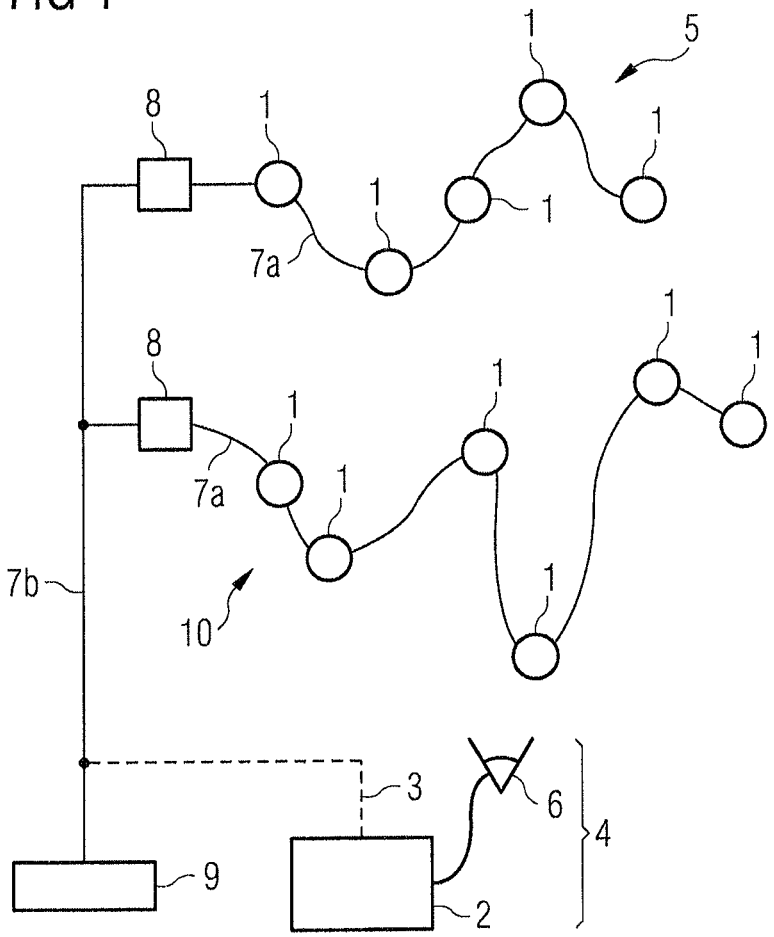
FIG. 1 shows a schematic illustration of an exemplary embodiment of a locating unit described here for a lighting system.

FIG. 1 schematically illustrates a lighting system 5 having an arrangement 10 with a plurality of light sources 1. Such lighting systems 5 are specified in the document WO 2010/088887 A2 and in the document DE 10 2009 007 505 A1, the disclosure content of which is concomitantly included by reference.

The light sources 1 of the lighting system 5 are semiconductor light sources such as light-emitting diodes, for example. A plurality of the light sources 1 are connected to a drive apparatus 8 via a data line 7*a*. The data line 7*a* is, in particular, a control bus which can be operated via an RDM protocol or an RDM-like protocol. The lighting system 5 comprises a plurality of drive apparatuses 8. The number of drive apparatuses 8 and of light sources 1 is illustrated only in a roughly simplified manner in FIG. 1.

The drive apparatuses 8 are connected to a control unit 9 via a further data line 7*b*, for example via an Internet link or a wireless radio link. The control unit 9 is a computer, for example. The control unit 9 outputs control signals to the drive apparatuses 8 which can be preprocessed by the drive apparatuses 8 and can be forwarded to the light sources 1. For example, temporally variable lighting patterns may be displayed by the lighting system 5.

A locating unit 4 is connected to the lighting system 5 via a data link 3 which is symbolized by a dashed line in FIG. 1. The data link 3 is a wire link or a wireless radio link.

The locating unit 4 comprises a computer 2 on which a program containing a method for locating the light sources 1 is implemented. An image recording device 6 is also connected to the computer 2. The image recording device 6 is preferably a so-called webcam. The image recording device 6 can be used to image at least one part of the arrangement 10 or the entire arrangement 10 of the light sources 1. A distance between the arrangement 10 and the image recording device 6 is preferably selected in such a manner that individual light sources 1 can be resolved by the image recording device 6. Unlike the situation illustrated in FIG. 1, it is likewise possible for the locating unit 4 to have two or more image recording devices 6.

FIG. 2 schematically illustrates an exemplary embodiment of a method for locating the light sources 1. In a highly simplified manner, the arrangement 10 according to FIG. 2A has only three light sources 1*a*, 1*b*, 1*c*.

In one step of the method (compare FIG. 2B), a list L which lists all light sources 1*a*, 1*b*, 1*c* and their identifiers 14*a*, 14*b*, 14*c* is created. The identifiers 14*a*, 14*b*, 14*c* allow unique logical identification and addressing of the light sources 1*a*, 1*b*, 1*c* in the arrangement 10. According to FIG. 2B, the identifiers 14*a*, 14*b*, 14*c* each schematically have only 4 bits. However, the identifiers 14*a*, 14*b*, 14*c* preferably comprise at least 32 bits or at least 48 bits, with the result that unique identifiers 14*a*, 14*b*, 14*c* are present even in the case of a very large number of light sources 1 in the arrangement 10. The list L is created, for example, with the aid of an RDM protocol or an RDM-like protocol. In this step of the method, all light sources 1*a*, 1*b*, 1*c* in the arrangement and their identifiers 14*a*, 14*b*, 14*c* are thus recorded.

Figure 2A:
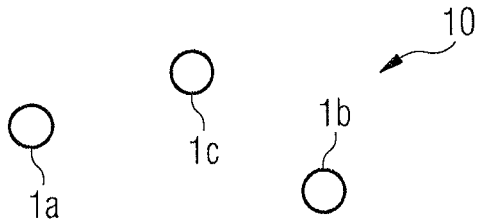
FIG. 2 shows a schematic illustration of a method described here for locating light sources.
Figure 2B:
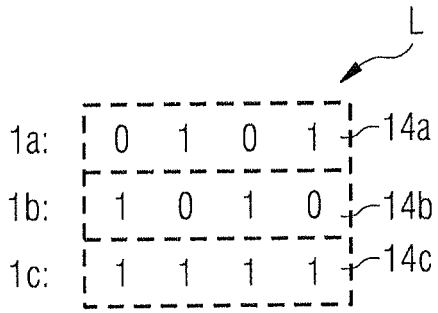
Figure 2C:
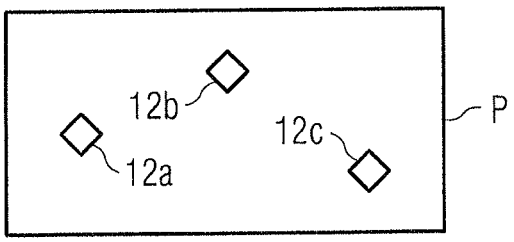
Figure 2D:
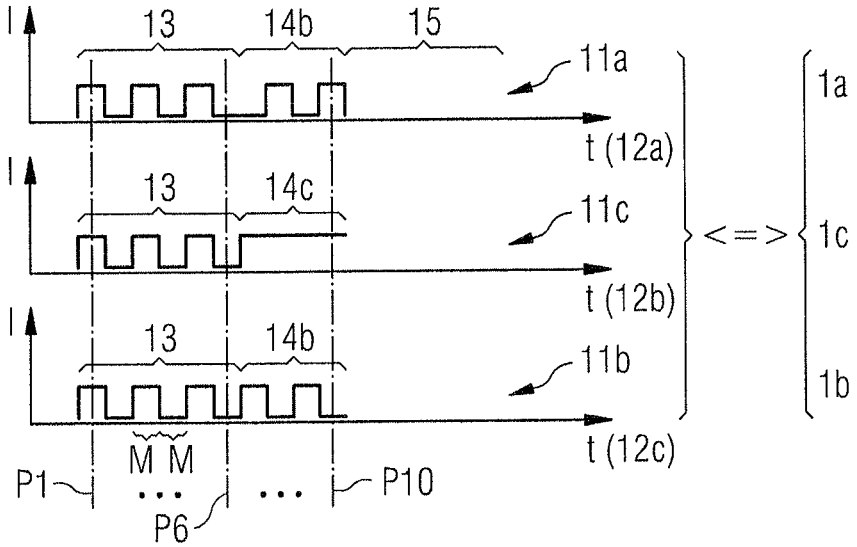

FIG. 2C illustrates an image P of the arrangement 10. The image P is recorded using the image recording device 6 of the locating unit 4, compare FIG. 1. FIG. 2D illustrates driving of the light sources 1*a*, 1*b*, 1*c* on the basis of the time t. Plotted against the time t in each case is a profile of a brightness l of the light sources 1*a*, 1*b*, 1*c*, that is to say light sequences 11*a*, 11*b*, 11*c* of the individual light sources 1*a*, 1*b*, 1*c*.

The light sources 1*a*, 1*b*, 1*c* are driven at the same time and synchronously at a particular clock rate, see FIG. 2D. One image P1-P10 is recorded for each clock pulse. In order to reduce background brightness, a starting image is preferably subtracted from all images P1-P10 before the images P1-P10 are processed further, all light sources 1*a*, 1*b*, 1*c* being switched off in the starting image. The starting image is, for example, the image P6 or an image recorded before the initiating sequence 13.

A control signal having an initiating sequence 13 with six successive bits in the sequence 101010, for example, is preferably first of all applied to all light sources 1*a*, 1*b*, 1*c* together. Six temporally successive light states M in the triple bright/dark sequence result therefrom. The light sources 1*a*, 1*b*, 1*c* are thus switched on together and then switched off together three times in succession.

Light source regions 12*a*, 12*b*, 12*c* can be identified in the image P (compare FIG. 2C) by repeatedly switching the light sources 1*a*, 1*b*, 1*c* on and off during the initiating sequence 13. The light source regions 12*a*, 12*b*, 12*c* are those regions in the image P in which the light sources 1*a*, 1*b*, 1*c* are imaged. An individual pixel, for example, from the light source regions 12*a*, 12*b*, 12*c* is used to represent the light sequences 11*a*, 11*b*, 11*c* (compare FIG. 2D).

After the initiating sequence 13 which is applied to all light sources 1*a*, 1*b*, 1*c* together, the light sources 1*a*, 1*b*, 1*c* are synchronously driven according to their individual identifiers 14*a*, 14*b*, 14*c* or with at least one bit sequence from the identifiers 14*a*, 14*b*, 14*c*. For example, the light sequence 11*a* with the bit sequence 0101 from the identifier 14*a* is recorded in the light source region 12*a* in the images P7-P10. Each of the images P7-P10 is assigned to precisely one light state M in the light sequences 11*a*, 11*b*, 11*c*. The temporal sequence of the light states M has a one-to-one correlation with the images P1-P10 in the image sequence.

As a result of the fact that the identifiers 14*a*, 14*b*, 14*c* occur in the temporal profile of the brightnesses l and thus in the individual light sequences 11*a*, 11*b*, 11*c* in the light source regions 12*a*, 12*b*, 12*c*, the light source region 12*a* can be uniquely assigned to the light source 1*a*, the light source region 12*b* can be uniquely assigned to the light source 1*c* and the light source region 12*c* can be uniquely assigned to the light source 1*b*, symbolized by a double-headed arrow in FIG. 2D.

Optionally, a further sequence of bits, for example a checksum sequence 15, can follow identifiers 14*a*, 14*b*, 14*c*.

The duration of the clock pulses is approximately 200 ms, for example. In other words, an interval of time between two successive images P is then likewise approximately 200 ms. In FIG. 2, a sequence of only 10 bits is applied to the light sources 1*a*, 1*b*, 1*c* in a highly simplified manner. A practical sequence of bits which is applied to the light sources comprises, for example, an initiating sequence of 16 bits, a unique identifier of 48 bits and a checksum sequence of 16 bits, corresponding to a sequence of a total of 80 bits. A very large number of light sources can be uniquely addressed by means of the identifier having 48 bits, for example. As a result of the fact that the number of images corresponding to the number of bits in the sequence is recorded, it is also possible to locate and assign the light sources within a short time in the case of a large number of light sources, in particular irrespective of the exact number of light sources. Hundreds or thousands of light sources of the lighting system can also be located in this manner within less than 30 seconds, for example.

The invention described here is not restricted by the description using the exemplary embodiments. Rather, the invention comprises any new feature and any combination of features, which includes, in particular, any combination of features in the patent claims even if this feature or this combination itself is not explicitly stated in the patent claims or exemplary embodiments.

I claim:

1. A method for locating light sources, comprising:

creating a list of light sources in an arrangement having a plurality of light sources, each of the light sources having a unique digital identifier with a bit sequence having a bit string;

simultaneously driving the light sources such that all the light sources are driven within a same clock pulse of a common clock frequency, to cause each of the light sources emits to emit a light sequence of successive light states corresponding to the bit sequence of the unique digital identifier associated with the respective light source such that the light states emitted by the individual light sources correspond, over the course of time, to the bit string of the bit sequence of the respective light source;

recording an image sequence of the arrangement by an image recording device during the driving operation; and locating a light source by matching a sequence of images in the image sequence to a sequence of light states in the light sequences corresponding to the associated unique digital identifier of the light source.

2. The method according to claim 1, wherein all of the light sources are switched on together and switched off together at least once.

3. The method according to claim 2, wherein the image recording device operates in a digital manner, and wherein light source regions are determined in the images in the image sequence by switching the light sources on and off together, at least one or precisely one of the light sources being imaged in each of the light source regions.

4. The method according to claim 3, wherein a temporal profile of a brightness of the light sequences in the light source regions, recorded in the image sequence, is compared with the bit sequence and/or with the identifier.

5. The method according to claim 3, wherein at least one of the light source regions comprises a plurality of pixels from the images and one of the pixels of the light source region is chosen in order to compare the profile of the brightness.

6. The method according to claim 1, wherein a starting image of the arrangement is subtracted from all images in the image sequence, all light sources being switched off in the starting image.

7. The method according to claim 1, wherein a number of images in the image sequence is equal to a number of light states in the light sequences and is equal to a number of bits in the bit sequence, each image in the image sequence being assigned to precisely one bit from the bit sequence.

8. The method according to claim 1, wherein the bit sequence comprises the complete identifier.

9. The method according to claim 1, wherein two image recording devices are used and/or in which the arrangement is recorded in three dimensions.

10. The method according to claim 1, wherein the arrangement comprises at least 100 light sources.

11. The method according to claim 1, wherein the arrangement is configured to light or illuminate part of a building and/or is configured to be fitted to part of a building.

12. The method according to claim 1, wherein at least some of the light sources are light-emitting diodes.

13. The method according to claim 4, further comprising determining one or more starting points, each starting point being formed by one or more particular light sources.

14. A computer program embodied in a non-transitory computer readable medium and which has program code that performs a method according to claim 1 if the computer program is executed in a computer.

15. A locating unit for locating light sources of a lighting system, comprising:

a computer;

a data link configured to be connected to an arrangement having a plurality of light sources of the lighting system and to individually drive the light sources; and at least one digital image recording device, the locating unit being set up to carry out a method according to claim 1.

* * * * *

UNITED STATES PATENT AND TRADEMARK OFFICE

CERTIFICATE OF CORRECTION

PATENT NO. : 9,282,618 B2
APPLICATION NO. : 13/247677
DATED : March 8, 2016
INVENTOR(S) : Philipp Van Beeck It is certified that error appears in the above-identified patent and that said Letters Patent is hereby corrected as shown below:

In the claims
In claim 1, line 9, delete "emits"

Signed and Sealed this
Seventh Day of June, 2016

Michelle K. Lee

Michelle K. Lee
*Director of the United States Patent and Trademark Office*